US010677116B2

(12) United States Patent
Tateno

(10) Patent No.: US 10,677,116 B2
(45) Date of Patent: Jun. 9, 2020

(54) DECOMPRESSION DEVICE FOR INTERNAL COMBUSTION ENGINE

(71) Applicant: TOYOTA JIDOSHA KABUSHIKI KAISHA, Toyota-shi, Aichi-ken (JP)

(72) Inventor: Manabu Tateno, Sunto-gun (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/282,985

(22) Filed: Feb. 22, 2019

(65) Prior Publication Data

US 2019/0301316 A1 Oct. 3, 2019

(30) Foreign Application Priority Data

Mar. 27, 2018 (JP) ..... 2018-060496

(51) Int. Cl.
*F01L 13/00* (2006.01)
*F01L 13/08* (2006.01)
*F01L 1/18* (2006.01)

(52) U.S. Cl.
CPC ..... *F01L 13/08* (2013.01); *F01L 1/18* (2013.01); *F01L 2109/00* (2013.01)

(58) Field of Classification Search
CPC . F01L 1/18; F01L 1/185; F01L 1/2405; F01L 1/46; F01L 13/08
USPC ..... 123/90.39, 90.43, 90.46
See application file for complete search history.

(56) References Cited

U.S. PATENT DOCUMENTS

2014/0182539 A1* 7/2014 Gron, Jr. ..... F01L 13/08 123/182.1

FOREIGN PATENT DOCUMENTS

JP 2016-017505 A 2/2016

* cited by examiner

*Primary Examiner* — Jorge L Leon, Jr.
(74) *Attorney, Agent, or Firm* — Oliff PLC

(57) ABSTRACT

A decompression pin is inserted into a swing range of an end portion of a rocker arm, on a side which is supported by a lash adjuster, when the rocker arm has been inclined toward a direction in which a valve is opened. The decompression pin comes into contact with the end portion of the rocker arm when the rocker arm is inclined toward a direction in which the valve is closed, and thereby restricts the rocker arm from returning to a position at which the valve is completely closed, and the valve becomes in a slightly opened state even in a compression stroke.

9 Claims, 17 Drawing Sheets

DECOMPRESSION DEVICE FOR INTERNAL COMBUSTION ENGINE

CROSS-REFERENCE TO RELATED APPLICATION

The present application claims priority under 35 U.S.C. § 119 to Japanese Patent Application No. 2018-060496, filed Mar. 27, 2018. The contents of this application are incorporated herein by reference in their entirety.

BACKGROUND

Field

The present invention relates to a decompression device for an internal combustion engine, and more specifically to a decompression device which releases a compression pressure in a combustion chamber, by slightly opening an intake valve or an exhaust valve at least in a compression stroke.

Description of Related Art

A decompression device (also referred to as a decompressor) is known which releases a compression pressure in a combustion chamber of an internal combustion engine. The decompression device is used, for example, in order to improve startability by reducing a compression torque at the time when the internal combustion engine is started.

JP 2016-017505 A discloses a decompression device that uses a valve timing mechanism which supports a rocker arm for operating a valve, by a lash adjuster. This decompression device is configured so as to lift the bottom of the lash adjuster by a cam, thereby move a fulcrum of the rocker arm to an upper side, in other words, to the side at which the valve opens, and thereby keep the valve in an opened state.

SUMMARY

A reaction force of a valve spring works on a plunger of the lash adjuster via the rocker arm. This reaction force increases as a contact portion between the plunger and the rocker arm, in other words, the fulcrum of the rocker arm moves upward. When the reaction force of the valve spring working on the plunger is large, the plunger is pushed by the reaction force, whereby oil leaks from the gap between the plunger and a housing, and the plunger is gradually pushed down. This phenomenon is referred to as a leak down of a plunger.

In the decompression device described in the above publication, there is a possibility that the leak down of the plunger occurs while the cam lifts the bottom of the lash adjuster. When the leak down of the plunger has occurred, the fulcrum of the rocker arm moves downward; and thereby the minimum lift amount of the valve in a compression stroke decreases, or the valve completely closes. In other words, in the decompression device described in the above publication, it is difficult to keep the valve in the opened state for a long time, and there is a possibility that as the decompression period becomes longer, a desired decompression effect to be obtained is lost.

An example of the present disclosure is intended to provide a decompression device for an internal combustion engine, which can keep the valve in the opened state for a long time.

A decompression device for an internal combustion engine according to an example of the present disclosure is a decompression device that is provided in an internal combustion engine having a valve timing mechanism including a rocker arm that receives a driving force from a cam to operate a valve in an opening direction, a valve spring that exerts a reaction force on the valve toward a closing direction, and a lash adjuster that forms a fulcrum of the rocker arm. The decompression device comprises a positioning member and an actuator for moving the positioning member. The positioning member is a member that is inserted into a swing range of an end portion of the rocker arm on a side which is supported by the lash adjuster, when the rocker arm has been inclined toward a direction in which the valve is opened. Hereinafter, the end portion of the rocker arm on the side which is supported by the lash adjuster is simply referred to as an "end portion of rocker arm". The positioning member comes into contact with the end portion of the rocker arm when the rocker arm is inclined toward a direction in which the valve is closed, and thereby restricts the rocker arm from returning to a position at which the valve is completely closed. The actuator performs an operation of inserting the positioning member into the swing range of the end portion of the rocker arm, and an operation of pulling out the positioning member from the swing range of the end portion of the rocker arm.

According to the decompression device configured as described above, when the valve is opened, the positioning member is inserted into the swing range of the end portion of the rocker arm, and is brought into contact with the end portion of the rocker arm, and thereby the contact portion between the positioning member and the rocker arm becomes the fulcrum of the rocker arm. In other words, the fulcrum of the rocker arm moves from the contact portion between the lash adjuster and the rocker arm, to the contact portion between the positioning member and the rocker arm. When the fulcrum of the rocker arm is regulated by the lash adjuster, the leak down of the plunger occurs due to a reaction force from the valve spring, whereby the fulcrum of the rocker arm is gradually displaced downward. However, when the fulcrum of the rocker arm is regulated by the positioning member, the fulcrum of the rocker arm is fixed, and accordingly it is prevented that the decompression lift amount (minimum lift amount) of the valve decreases due to the lapse of time. In other words, the decompression device configured as described above can keep the valve in an opened state for a long time.

The positioning member may be provided with a flat portion, at a portion coming into contact with the end portion of the rocker arm. Because the portion coming into contact with the rocker arm is flat, the contact pressure between the rocker arm and the positioning member can be reduced.

The positioning member may also be provided with a plunger engagement portion that engages a plunger of the lash adjuster. The plunger engagement portion is configured to engage the plunger and restrain a movement in an axial direction of the plunger when the positioning member has come into contact with the end portion of the rocker arm. By restraining the movement of the plunger in the axial direction, the positioning member can suppress the upward extension of the plunger toward the rocker arm, while the rocker arm swings with the contact portion between the positioning member and the rocker arm as a fulcrum. Because of this, by pulling out the positioning member, the decompression device can immediately release the decompressed state.

The positioning member may be driven toward the plunger in a linear direction by the actuator, and may be provided with the plunger engagement portion at a tip end in the linear direction. According to this, it is possible to achieve the insertion of the positioning member into the swing range of the end portion of the rocker arm and the engagement of the plunger engagement portion with the plunger, by a simple single action.

The decompression device for the internal combustion engine according to the present invention may include a support member for supporting the positioning member. The support member guides the positioning member so as to move toward the plunger along the linear direction, and also supports the positioning member against the reaction force of the valve spring, which works on the positioning member via the rocker arm. By having such a support member, the decompression device can surely insert the positioning member into a desired position, surely engage the plunger engagement portion with the plunger, and also enhance the rigidity of the positioning member against the reaction force of the valve spring.

The actuator may be configured so as to drive the positioning member toward the plunger by a force of a solenoid when the decompression starts, to continue energization of the solenoid while the decompression is continued, and to stop the energization of the solenoid and return the positioning member to an original position by a reaction force of a spring when finishing the decompression. Furthermore, the actuator may start energization of the solenoid before the attitude of the rocker arm becomes an attitude in which the positioning member can be inserted into the swing range. In addition, the actuator may stop the energization of the solenoid before the valve starts to lift in the decompression finishing cycle. The actuator having the above described configuration can insert the positioning member into a desired position without strict control of the timing, and can pull out the positioning member.

The positioning member and the actuator may constitute an actuator unit. In this case, the actuator unit may be mounted on the internal combustion engine so that the driving direction of the positioning member is inclined with respect to the longitudinal direction of the rocker arm, in a top view of a cylinder. Various components such as a fuel injection valve are present in the vicinity of the valve of the internal combustion engine, but according to the above described configuration, the actuator unit can be mounted so as not to interfere with these other components.

As described above, the decompression device for the internal combustion engine of the example of the present disclosure inserts the positioning member into the swing range of the end portion of the rocker arm, moves the fulcrum of the rocker arm from the contact portion between the lash adjuster and the rocker arm to the contact portion between the positioning member and the rocker arm, thereby restricts the rocker arm from returning to the position at which the valve is completely closed, and thereby can keep the valve in an opened state for a long time.

DESCRIPTION OF EMBODIMENTS

Embodiments of the present invention will be described below with reference to the drawings. However, in the case where the number, quantity, amount, range and the like of each element are mentioned in the following embodiments, the present invention is not limited by the mentioned number, except for the case where the number is clearly stated or the number is clearly specified in principle. In addition, the structures described in the following embodiments are not necessarily compulsory for the present invention, except for the case where the structure is clearly stated or the structure is clearly specified in principle.

1. Configuration of Decompression Device

An internal combustion engine (hereinafter referred to as an engine) to which the decompression device of the present embodiment is applied includes, for example, a spark ignition type engine and a diesel engine. In addition, the decompression device of the present embodiment can be applied not only to a conventional engine but also to an engine for a hybrid system which combines an engine with a motor.

Figure 1:
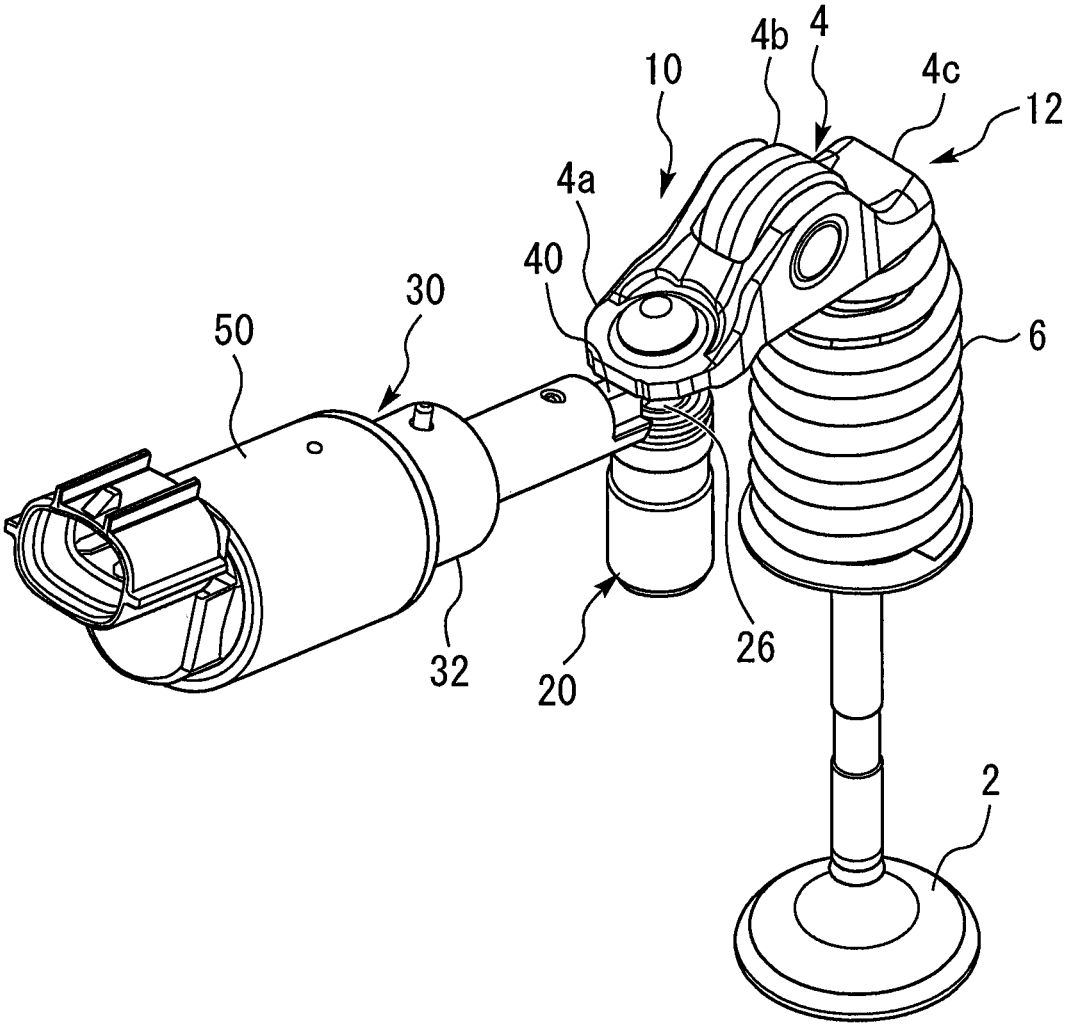
FIG. 1 is a perspective view illustrating a decompression device according to an embodiment of the present disclosure.

FIG. 1 shows a perspective view showing a decompression device of the present embodiment. A decompression device 10 of the present embodiment is combined with a valve timing mechanism 12 which operates a valve 2. The valve 2 may be an intake valve or an exhaust valve. The valve timing mechanism 12 includes a rocker arm 4. At approximately the center between both end portions 4*a* and 4*c* of the rocker arm 4, a rocker roller 4*b* which receives a driving force from a not shown cam is provided. The rocker roller 4*b* forms a force point of the rocker arm 4 working as a lever.

An end portion of a shaft of the valve 2 is in contact with one end portion 4*c* of the rocker arm 4. A retainer for transmitting a reaction force of a valve spring 6 to the valve 2 is fixed to the end portion of the shaft of the valve 2. The reaction force of the valve spring 6 works toward a closing direction with respect to the valve 2, in other words, in a direction of pushing up the end portion 4*c* of the rocker arm 4. The end portion 4*c* of the rocker arm 4, more specifically, a contact portion between the end portion 4*c* and the valve 2, forms the point of action of the rocker arm 4 working as a lever.

The other end portion 4*a* of the rocker arm 4 is supported by a lash adjuster (Hydraulic Lash Adjuster, HLA) 20. The end portion 4*a* of the rocker arm 4, more specifically, a contact portion between the end portion 4*a* and the lash adjuster 20 forms a fulcrum of the rocker arm 4 working as a lever. The basic structure of the lash adjuster 20 is the same as that of a conventional one. However, an annular groove 26 is formed on the whole periphery of a plunger of the lash adjuster 20 (which is hidden behind the end portion 4*a* in the drawing), which will be described in detail later.

The decompression device 10 of the present embodiment includes an actuator unit 30 which works on the valve timing mechanism 12 having the above described configuration. The actuator unit 30 is a device in which at least a decompression pin 40, a solenoid 50 and a pin guide 32 are integrated. The decompression pin 40 is a positioning member which positions the rocker arm 4 during decompression. The solenoid 50 is an actuator which moves the decompression pin 40 in its axial direction. The pin guide 32 is a support member which guides the movement of the decompression pin 40 in the axial direction and supports the decompression pin 40 against a lateral load applied to the decompression pin 40.

Figure 2:
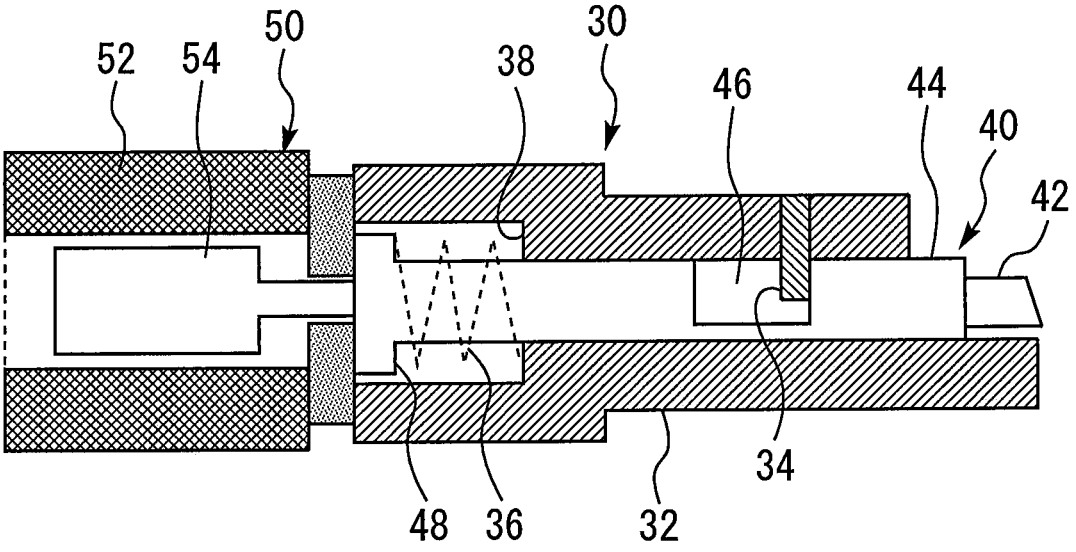
FIG. 2 is a schematic cross-sectional view illustrating an actuator unit of the decompression device according to the embodiment of the present disclosure.
Figure 3:
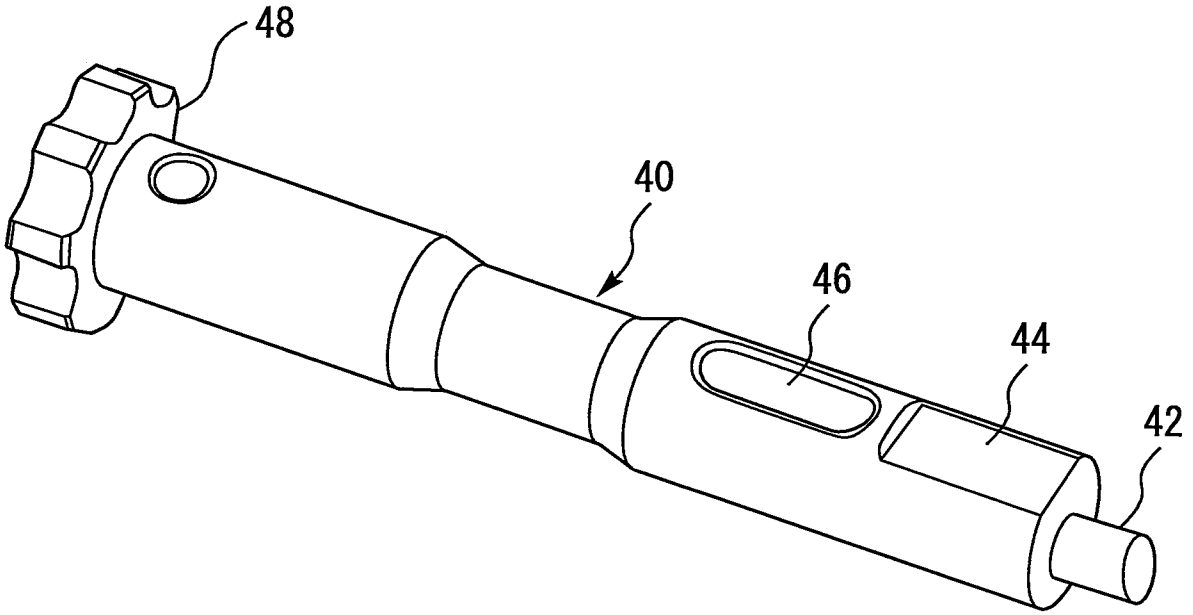
FIG. 3 is a perspective view illustrating a decompression pin of the decompression device according to the embodiment of the present disclosure.

FIG. 2 shows a schematic cross-sectional view of the actuator unit 30. FIG. 3 shows a perspective view of the decompression pin 40 which constitutes the actuator unit 30. The pin guide 32 is cylindrical, and accommodates the decompression pin 40 in the inside. In the decompression pin 40, a groove 46 is formed which extends in the axial direction. A detent pin 34 which is fixed to the pin guide 32 is inserted in the groove 46. Due to the detent pin 34 which is engaged with the groove 46, the rotation of the decompression pin 40 in the circumferential direction is restrained.

The solenoid 50 is attached to an end portion of the pin guide 32. The solenoid 50 includes an armature 54 and an electromagnetic coil 52 for driving the armature 54. When a voltage is applied to the electromagnetic coil 52, the tip of the armature 54 protrudes to the inside of the pin guide 32 and pushes the decompression pin 40 in the direction of its tip. The voltage is applied to the electromagnetic coil 52 from a not shown ECU (Electronic Control Unit).

In the inside of the pin guide 32, a spring 36 is accommodated together with the decompression pin 40. The spring 36 is held between a spring bearing 48 which is formed at the end of the decompression pin 40 and a step 38 which is formed in the inside of the pin guide 32. The decompression pin 40 which has been pushed out toward the tip direction by the energization of the solenoid 50 is pushed back to the original position by the reaction force of the spring 36, when the energization of the solenoid 50 has been stopped. Incidentally, notches of the spring bearing 48 drawn in FIG. 3 are passages for discharging oil which has entered naturally from the engine.

The decompression pin 40 has a plunger engagement portion 42 which protrudes from a tip portion thereof. The plunger engagement portion 42 is columnar, and is thinner than the main portion of the decompression pin 40. The plunger engagement portion 42 can engage with the above described plunger groove 26 (see FIG. 1) by the decompression pin 40 being pushed out from the pin guide 32 by the solenoid 50. In addition, the decompression pin 40 is provided with a planar arm support portion 44 on the upper side of its tip portion. At the time of decompression, the end portion 4*a* of the rocker arm 4 is supported by the planar arm support portion 44.

2. Mechanism of Decompression by Decompression Device

Figure 4A:
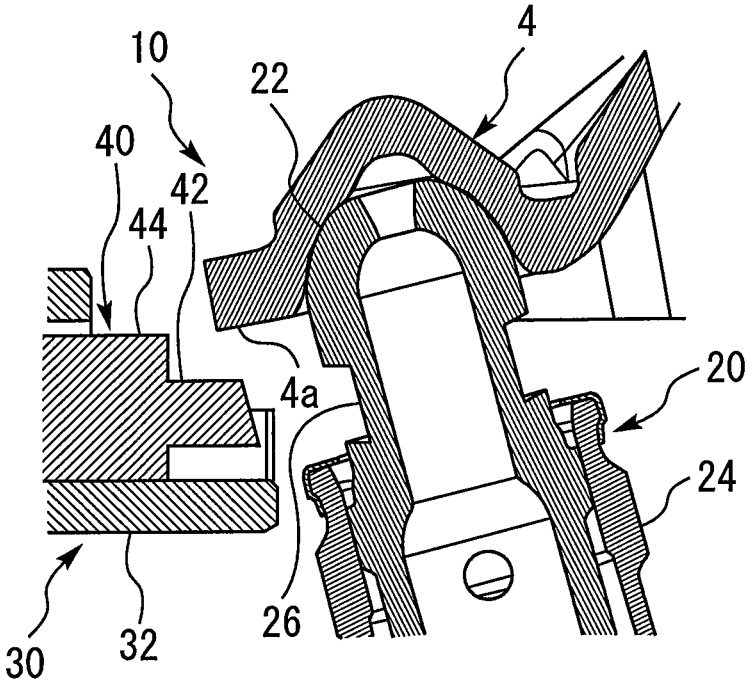
FIG. 4A is a view illustrating an engaged state of each member at a normal time.
Figure 4B:
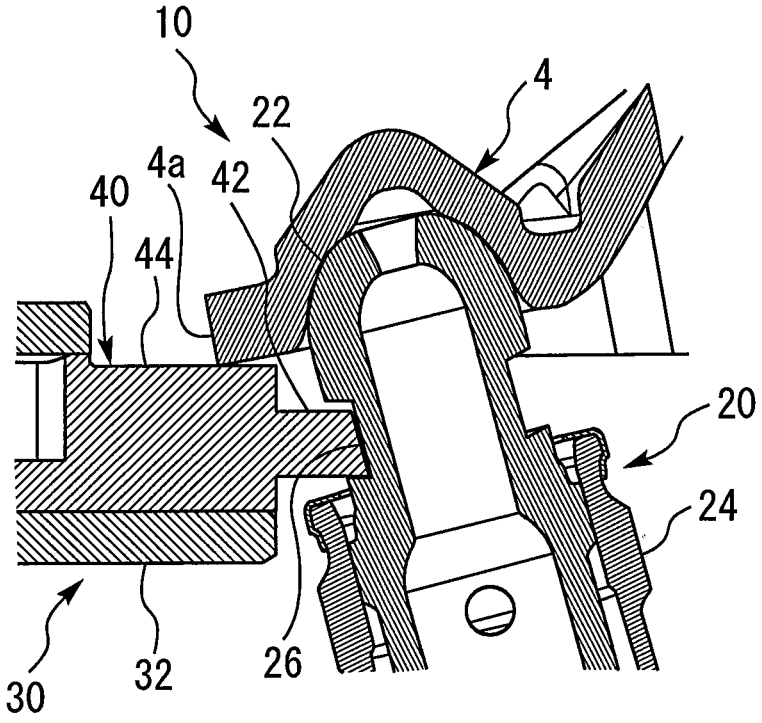
FIG. 4B is a view illustrating an engaged state of each member during decompression.

Next, the decompression mechanism of the decompression device 10 of the present embodiment will be described in detail with reference to FIGS. 4 to 8. Firstly, FIG. 4A shows a view showing an engaged state of each member at a normal time. FIG. 4B shows a view showing an engaged state of each member in the decompressed state.

At the normal time, the decompression pin 40 is accommodated in the pin guide 32, as shown in the state in FIG. 4A. In this state, the decompression pin 40 is positioned outside the swing range in which the end portion 4*a* of the rocker arm 4 swings, and does not interfere with the rocker arm 4. Therefore, the end portion 4*a* of the rocker arm 4 is supported by a plunger 22 of the lash adjuster 20. The plunger 22 extends and retracts with respect to a casing 24 according to the movement of the end portion 4*a* of the rocker arm 4.

On the other hand, at the time of decompression, the decompression pin 40 protrudes toward the plunger 22 of the lash adjuster 20 from the pin guide 32, as shown in the state in FIG. 4B. The protruded decompression pin 40 is positioned in the swing range in which the end portion 4*a* of the rocker arm 4 swings, and the end portion 4*a* of the rocker arm 4 comes into contact with the arm support portion 44 of the decompression pin 40. In this state, the end portion 4*a* of the rocker arm 4 is supported by the arm support portion 44. The position of the end portion 4*a* of the rocker arm 4 at the time when the end portion 4*a* is supported by the arm support portion 44 is above the position of the end portion 4*a* of the rocker arm 4 at the time when the end portion 4*a* is supported by the plunger 22. Because of this, the rocker arm 4 is restricted from returning to a position at which the valve is completely closed, and the state in which the valve is opened at all times, in other words, the decompressed state is achieved.

In addition, at the time of decompression, the plunger engagement portion 42 of the decompression pin 40 is engaged with the groove 26 of the plunger 22, as shown in the state in FIG. 4B. The groove 26 is annularly formed around the whole periphery so that the plunger engagement portion 42 can be engaged regardless of how the plunger 22 rotates. By the plunger engagement portion 42 being engaged with the groove 26, the plunger 22 is restrained from moving in the axial direction. When the rocker arm 4 swings, the plunger 22 expands or contracts normally in response to the movement of the rocker arm 4. However, because the movement in the axial direction is restrained by the plunger engagement portion 42, the position of the plunger 22 remains fixed regardless of the movement of the rocker arm 4. The technical significance of the position of the plunger 22 being fixed will be described later.

Figure 5:
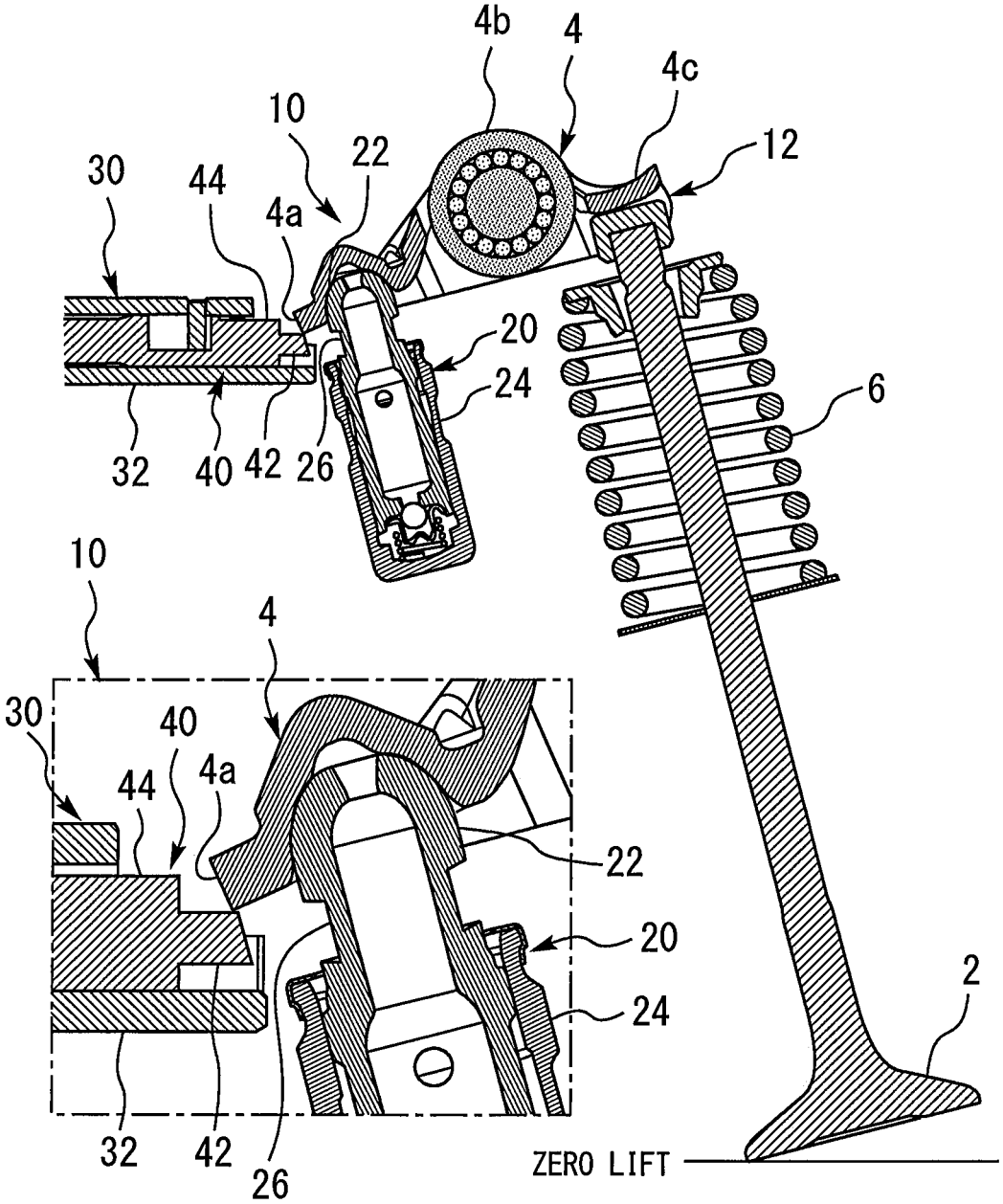
FIG. 5 is a view illustrating a state of a valve timing mechanism and a state of the decompression device, in a valve closed state.
Figure 6:
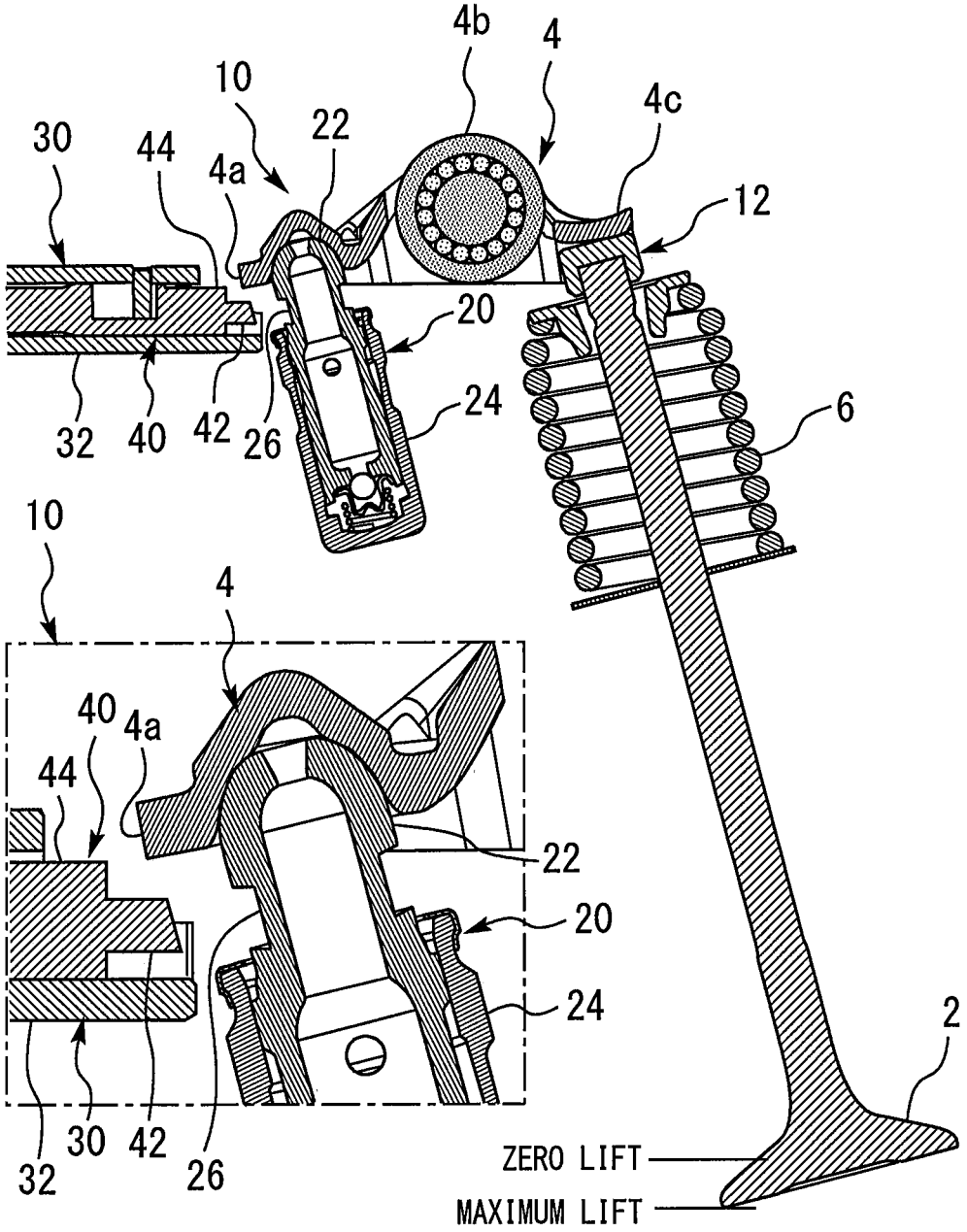
FIG. 6 is a view illustrating a state of the valve timing mechanism in the maximum lift state and a state of the decompression device before the decompression pin is inserted.
Figure 7:
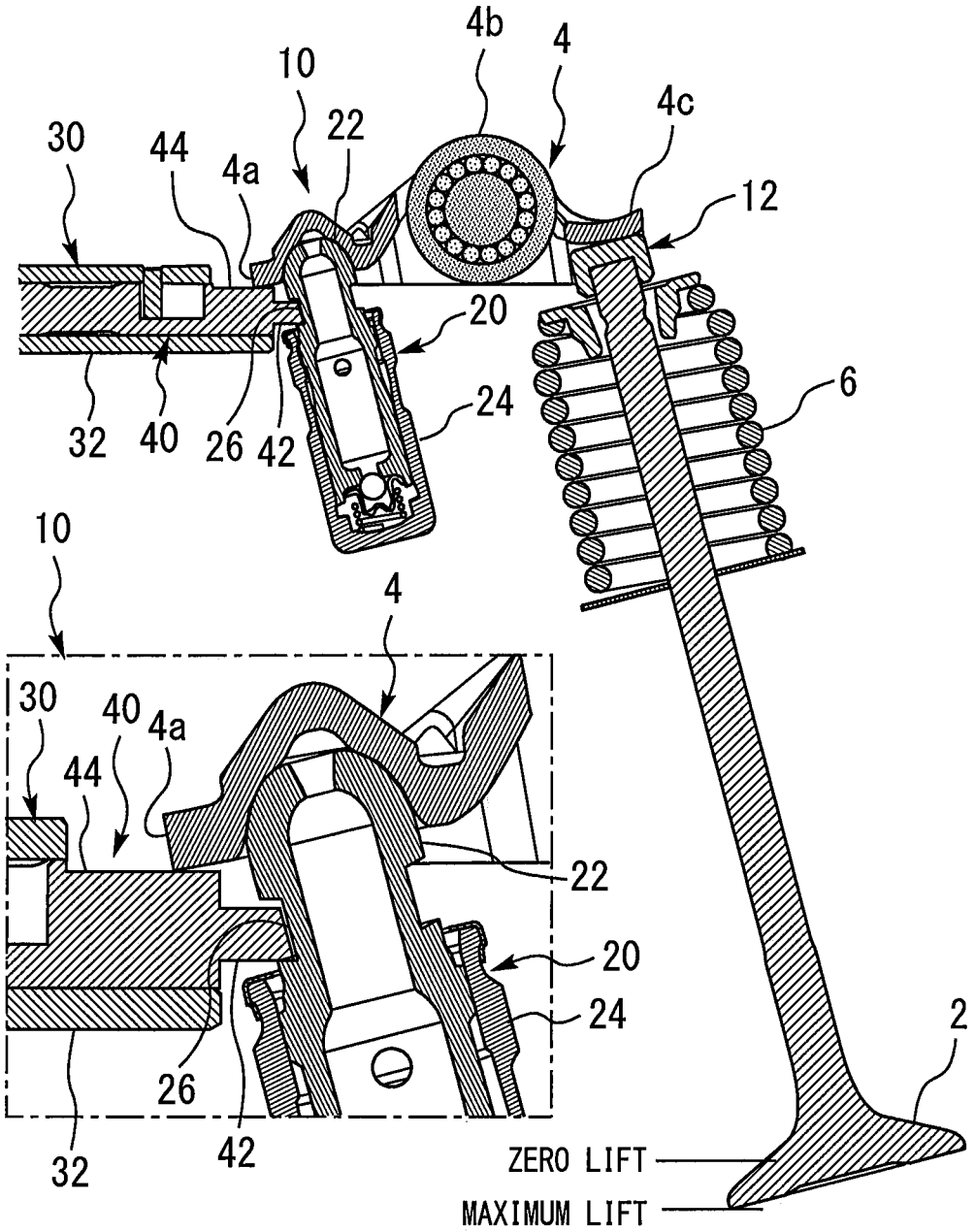
FIG. 7 is a view illustrating a state of the valve timing mechanism in the maximum lift state and the state of the decompression device after the decompression pin has been inserted.
Figure 8:
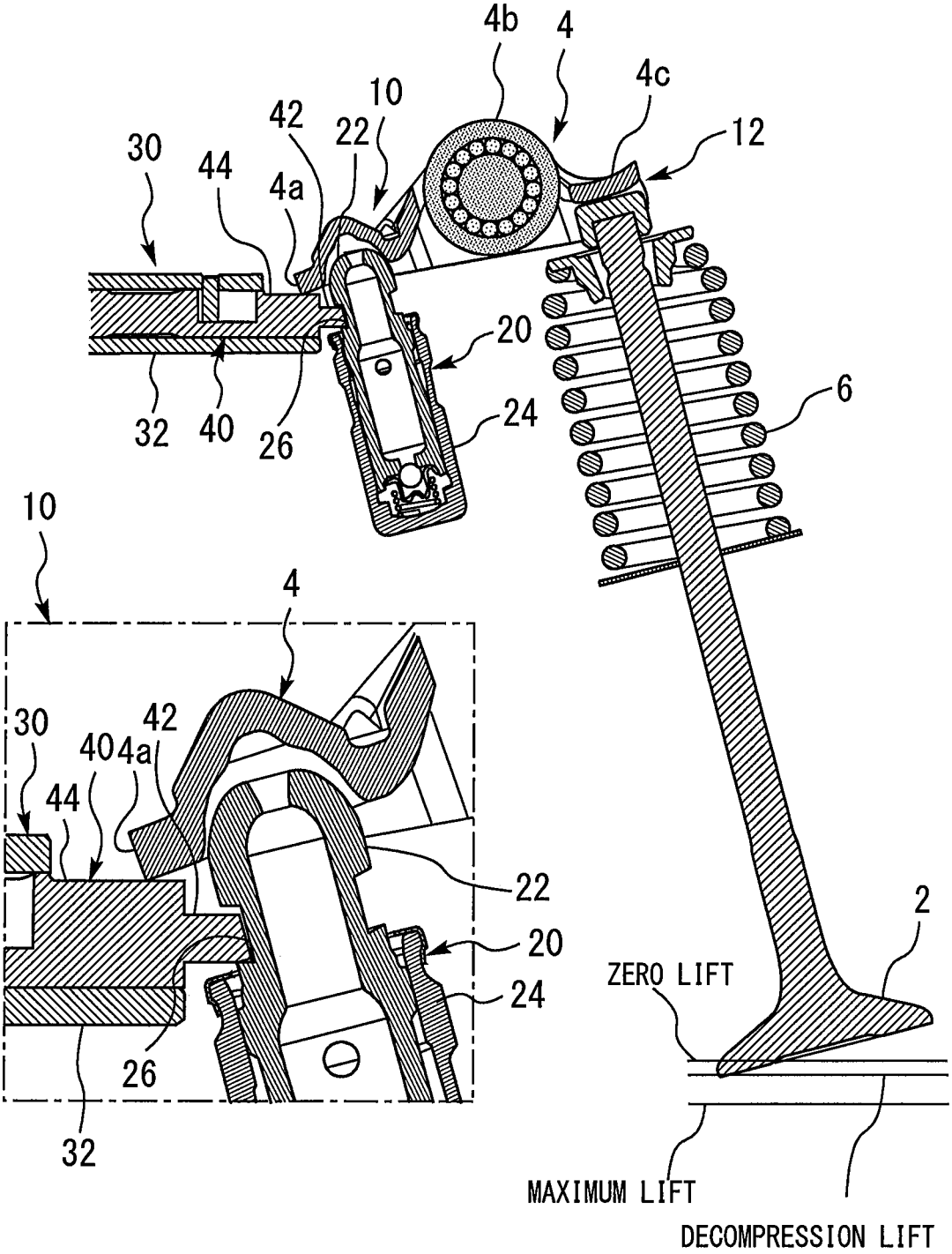
FIG. 8 is a view illustrating a state of the valve timing mechanism and a state of the decompression device, in a decompressed state.

FIGS. 5 to 8 are views showing transition of each state of the valve timing mechanism 12 and the decompression device 10, in a period in which the valve starts from the valve closed state and reaches a decompressed state through the maximum lift state. FIG. 5 shows a state of the valve timing mechanism 12 and a state of the decompression device 10, each in the valve closed state. FIG. 6 shows a state of the valve timing mechanism 12 in the maximum lift state, and a state of the decompression device 10 before the decompression pin 40 is inserted. FIG. 7 shows a state of the valve timing mechanism 12 in the maximum lift state, and a state of the decompression device 10 after the decompression pin 40 has been inserted. In addition, FIG. 8 shows a state of the valve timing mechanism 12 and a state of the decompression device 10, each in the decompressed state. In each figure, the state of the decompression device 10 is enlarged and drawn within the frame enclosed by the alternate long and short dashed lines.

As shown in FIG. 5, in the valve closed state in which a lift amount of the valve 2 is zero, the end portion 4*c* of the rocker arm 4 on the side supporting the valve 2 is maximally raised, and the end portion 4*a* on the side supported by the lash adjuster 20 goes down along therewith. At this time, the end portion 4*a* of the rocker arm 4 approaches the decompression pin 40, but as shown in the enlarged view, a clearance is provided between the tip portion of the decompression pin 40 and the end portion 4*a* of the rocker arm 4. Thereby, the rocker arm 4 can be inclined to a position at which the valve 2 is completely closed, without being interfered with by the decompression pin 40.

As shown in FIG. 6, in the maximum lift state in which the lift amount of the valve 2 becomes maximum, the end portion 4*c* of the rocker arm 4 on the side supporting the valve 2 is lowered to the lowest position, and the end portion 4*a* on the side supported by the lash adjuster 20 is raised therewith. At this time, as shown in the enlarged view, a clearance is formed below the end portion 4*a* of the rocker arm 4 so that the decompression pin 40 can be inserted thereinto. At the start of the decompression, the decompression pin 40 is inserted into this clearance, as shown in FIG. 7. The tip of the inserted decompression pin 40, in other words, the plunger engagement portion 42 engages with the groove 26 of the plunger 22 and restrains the movement in the axial direction of the plunger 22.

As shown in FIG. 8, in the decompressed state, the end portion 4*a* of the rocker arm 4 comes into contact with the arm support portion 44 of the decompression pin 40 which has been inserted in the maximum lift state, and the position of the fulcrum of the rocker arm 4 working as the lever is regulated by the decompression pin 40. Because of this, the rocker arm 4 cannot be inclined to a position at which the valve 2 is completely closed, and the valve 2 is slightly opened even when the rocker arm 4 has been inclined to the utmost extent. The lift amount of the valve 2 at this time (in other words, the decompression lift amount) is determined according to the position of the fulcrum which is regulated by the arm support portion 44 of the decompression pin 40. The position and the size of the arm support portion 44 of the decompression pin 40 are designed so that the decompression lift amount becomes a desired amount.

In addition, in the decompressed state, the movement in the axial direction of the plunger 22 is restrained by the plunger engagement portion 42, and thereby the plunger 22 cannot follow the movement of the rocker arm 4. Because of this, when the rocker arm 4 is inclined, a gap remains formed between the end portion 4*a* of the rocker arm 4 and the plunger 22, as shown in the enlarged view.

Figure 9:
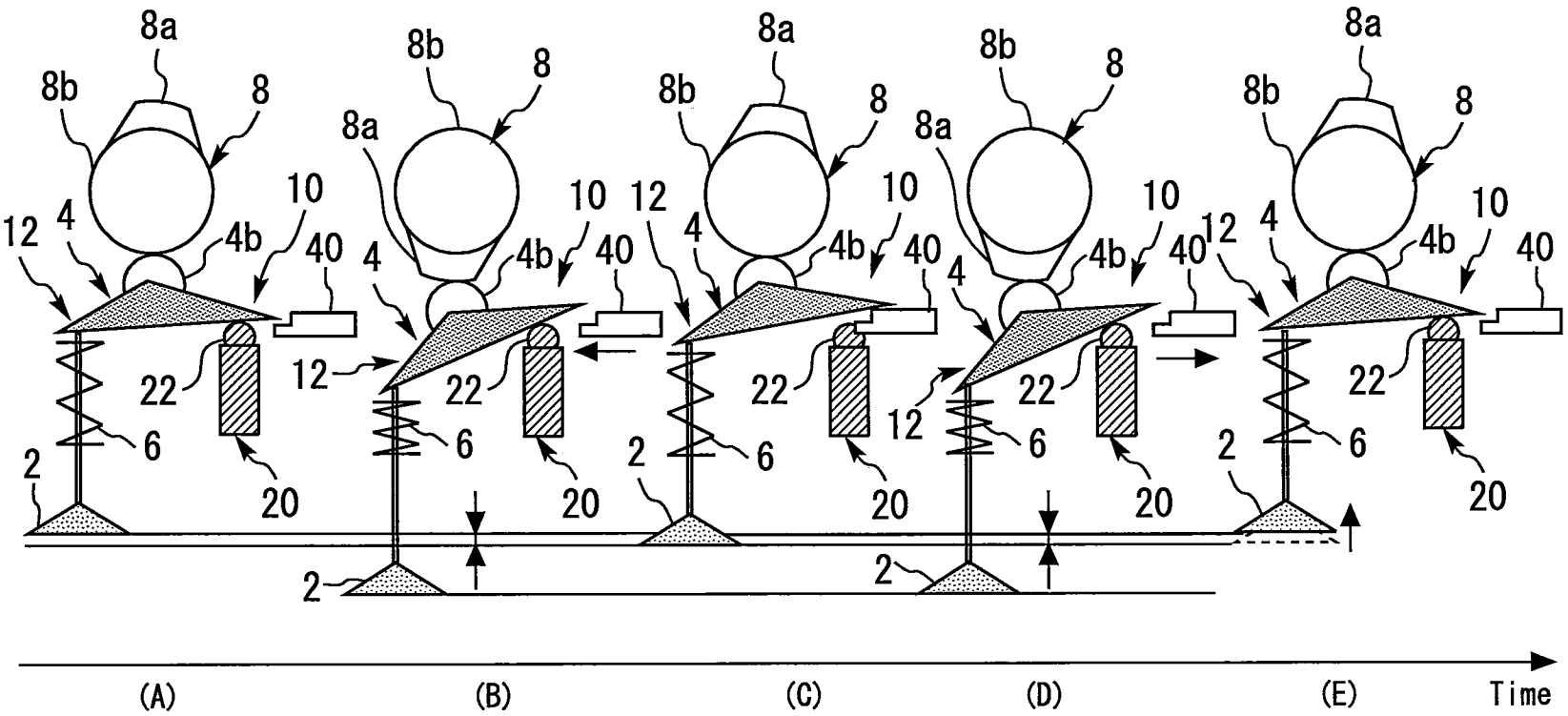
FIG. 9 is a view illustrating actions of the valve timing mechanism accompanying operations of the decompression device in the embodiment of the present disclosure, in time series.

Next, the technical significance that the plunger 22 is restrained by the plunger engagement portion 42 will be described with reference to FIG. 9 and FIG. 10. FIG. 9 shows a view showing actions of the valve timing mechanism 12 accompanying operations of the decompression device 10 of the present embodiment, in time series. As shown in FIG. 9, at the time (A), a base circle portion 8*b* of a cam 8 is in contact with the rocker roller 4*b*. When the decompression pin 40 is not inserted, the lift amount of the valve 2 at this time becomes zero.

At the time (B), a lift portion 8*a* of the cam 8 is in contact with the rocker roller 4*b*, and pushes down the rocker arm 4. As the inclination of the rocker arm 4 increases, the lift amount of the valve 2 increases. The decompression pin 40 is inserted approximately when the lift amount of the valve 2 becomes maximum.

At the time (C), the cam 8 rotates, and the base circle portion 8*b* of the cam 8 is in contact with the rocker roller 4*b* again. However, by the decompression pin 40 being inserted, the inclination of the rocker arm 4 is limited. Thereby, the valve 2 cannot be completely closed, and the decompression lift amount is maintained. In addition, by the decompression pin 40 being inserted, the movement in the axial direction of the plunger 22 of the lash adjuster 20 is restrained. Because of this, the plunger 22 cannot extend upward in response to a change of the inclination of the rocker arm 4.

At the time (D), approximately when the lift amount of the valve 2 reaches the maximum again, the decompression pin 40 becomes such a state as to be capable of being pulled out. In this state, the plunger 22 of the lash adjuster 20 comes into contact with the rocker arm 4, and the position is held. Because of this, even if the decompression pin 40 has been pulled out, the position of the rocker arm 4 does not change, and the state of the valve becomes a lift state at the time of the maximum lift which is not different from the normal state.

At the time (E), the decompression pin 40 is pulled out. By the decompression pin 40 being pulled out, the rocker arm 4 swings while coming into contact with the plunger 22. The plunger 22 is at the normal position from the time (D), and accordingly the lift amount of the valve 2 becomes zero when the base circle portion 8*b* of the cam 8 has come into contact with the rocker roller 4*b*. In other words, the decompressed state is released.

As described above, the decompression device 10 of the present embodiment restrains the movement of the plunger 22 in the axial direction by the decompression pin 40, and thereby can suppress the upward extension of the plunger 22 toward the rocker arm 4, while the rocker arm 4 is swinging while keeping the decompressed state. Because of this, the decompression device can immediately release the decompressed state by pulling out the decompression pin 40.

Figure 10:
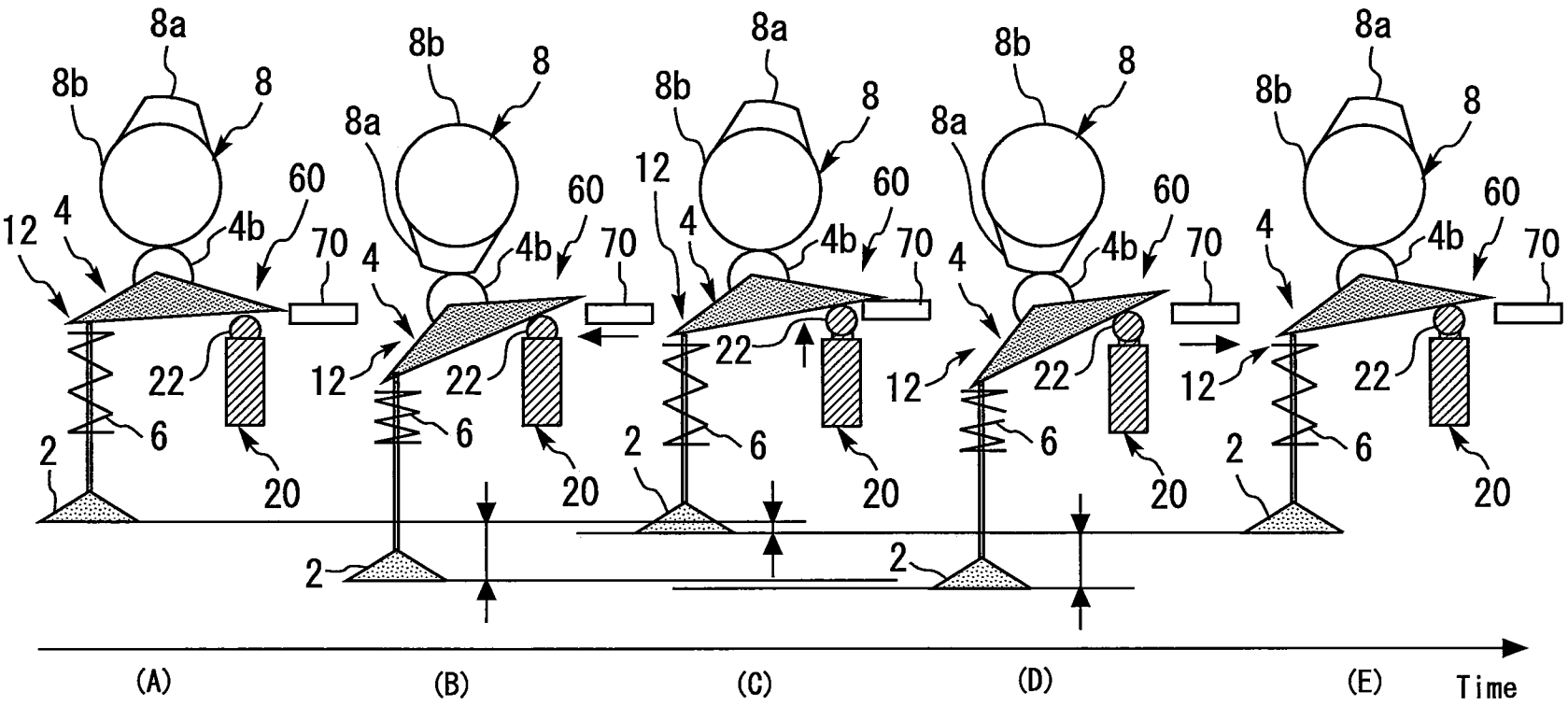
FIG. 10 is a view illustrating actions of the valve timing mechanism accompanying the operations of the decompression device of a comparative example, in time series.

FIG. 10 shows a view showing actions of the valve timing mechanism 12 accompanying operations of a decompression device 60 of a comparative example, in time series. The comparative example is another embodiment of the present invention, which is different from the present embodiment. There is a difference between the present embodiment and the comparative example, in a configuration of the decompression pin. A decompression pin 70 of the decompression device 60 of the comparative example does not have a plunger engagement portion which is engaged with the plunger 22 and restrains the movement thereof in the axial direction. In other words, the decompression pin 70 of the comparative example has only a function as a positioning member for restricting the rocker arm 4 from returning to the position at which the valve 2 is completely closed.

The time in FIG. 9 and the time in FIG. 10 correspond to each other. Also, in the comparative example, the decompression pin 70 is inserted at the time (B) approximately when the lift amount of the valve 2 becomes maximum.

At the time (C), the cam 8 rotates and the base circle portion 8*b* of the cam 8 is in contact with the rocker roller 4*b*. Also, in the comparative example, the decompression pin 70 is inserted and the inclination of the rocker arm 4 is limited, thereby the valve 2 cannot be completely closed, and the decompression lift amount is maintained. On the other hand, the movement in the axial direction of the plunger 22 is not restrained by the decompression pin 70, and accordingly the plunger 22 extends upward corresponding to the change of the inclination of the rocker arm 4, and narrows the gap between itself and the rocker arm 4.

At the time (D), approximately when the lift amount of the valve 2 reaches the maximum again, the decompression pin 70 becomes such a state as to be capable of being pulled out. In this state, the plunger 22 of the lash adjuster 20 can extend upward because of no restraint due to the decompression pin 70, thereby coming into contact with the rocker arm 4 at a position higher than the normal maximum lift position, and the position is held. Because of this, even if the decompression pin 70 is pulled out, the rocker arm 4 cannot return to the position at the time of the previous maximum lift, and the lift amount increases more than that at the time of the normal maximum lift.

At the time (E), the decompression pin 70 is pulled out. By the decompression pin 70 being pulled out, the locker arm 4 is released from the restraint by the decompression pin 70. However, the plunger 22 which has been extended upward at the time of decompression is in contact with the rocker arm 4, and accordingly the attitude of the rocker arm 4 accompanying the pulling out of the decompression pin 70 does not largely change. The plunger 22 is located above the normal position since the time (D), and accordingly the lift amount of the valve 2 does not become zero when the base circle portion 8*b* of the cam 8 comes into contact with the rocker roller 4*b*. In other words, the decompressed state continues after the decompression pin 70 has been pulled out.

As described above, the decompression device 10 of the present embodiment can immediately release the decompressed state by pulling out the decompression pin 40, but on the other hand, the decompression device 60 of the comparative example continues in the decompressed state after the decompression pin 70 has been pulled out. In other words, the technical significance that the plunger 22 is restrained by the decompression pin 40 is that the decompressed state can be immediately released when the decompression pin 40 is pulled out. In the comparative example, the decompressed state is continued until the plunger 22 retracts due to the leak down.

3. Control Over Decompression Device

Figure 11:
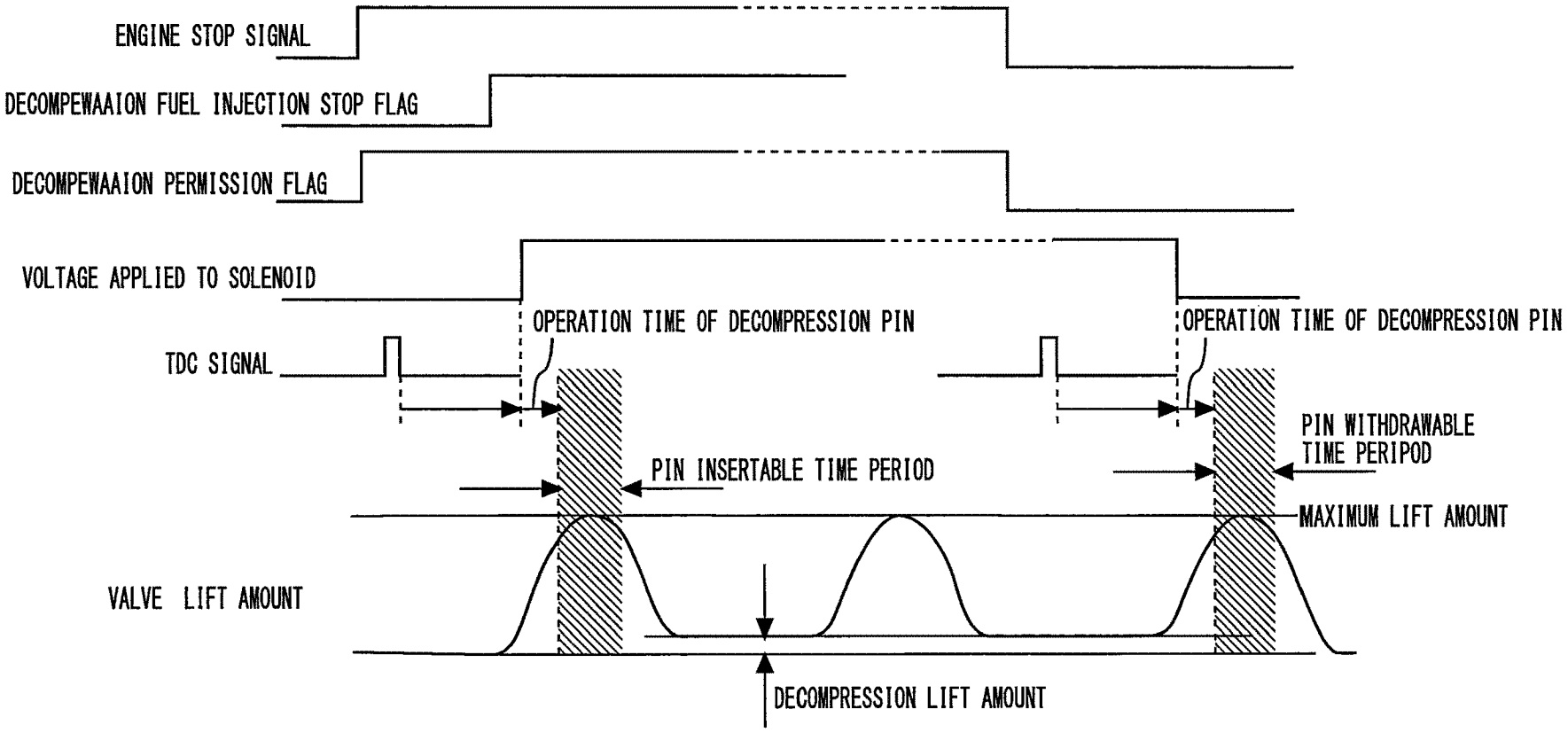
FIG. 11 is a view illustrating a time chart of control over the decompression device in between the start of decompression and the end of the decompression.

Next, control over the decompression device 10 of the present embodiment will be described with reference to FIGS. 11 to 16. Firstly, FIG. 11 is a time chart of the control over the decompression device 10 in a period from the start of decompression to the end of decompression. In the time chart, each waveform of an engine stop signal, a decompression cylinder fuel injection stop flag, a decompression permission flag, a voltage applied to the solenoid, a TDC signal, and a valve lift amount are drawn sequentially from the top.

Firstly, when the engine stop signal is turned on, the decompression permission flag is set. When the decompression permission flag is set, a cylinder which can start the decompression first is discriminated on the basis of the TDC signal. Next, the injection of fuel is stopped to the cylinder to be decompressed, and at the same time, a voltage is applied to the solenoid 50 of the decompression device 10 on the cylinder.

A certain operation time (for example, approximately 40 msec) is required before the decompression pin 40 is operated by the thrust force of the solenoid 50 after the voltage has been applied to the solenoid 50. The timing at which the voltage is applied to the solenoid 50 is set so that the decompression pin 40 can be operated within a time period during which the decompression pin 40 can be inserted, in consideration of this operation time. The decompression pin 40 can be inserted into the swing range of the rocker arm 4, approximately when the lift amount of the valve 2 becomes maximum.

From the viewpoint of suppressing the power consumption accompanying the start of the decompression, the timing at which the voltage is applied to the solenoid 50 should be as late as possible. However, if reliability is required, it is better that the timing is earlier at which the voltage is applied to the solenoid 50. The decompression device 10 of the present embodiment can start the energization of the solenoid 50 before the attitude of the rocker arm 4 becomes an attitude at which the decompression pin 40 can be inserted into the swing range of the rocker arm 4.

Figure 12:
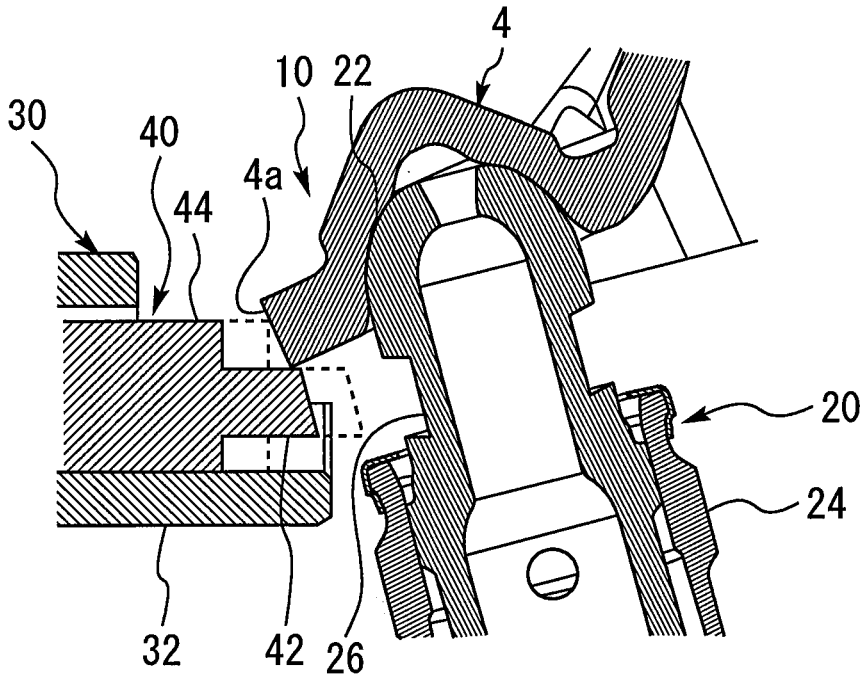
FIG. 12 is a view for describing control over the decompression device at the start of decompression.

FIG. 12 is a view for describing the control over the decompression device 10 at the start of the decompression. For example, suppose that the energization of the solenoid 50 is started in a valve closed state to operate the decompression pin 40. In this case, as shown by a dotted line in the drawing, the step part at the tip of the decompression pin 40 hits the end portion 4*a* of the rocker arm 4, and accordingly it is impossible to insert the decompression pin 40 any further.

However, if the voltage continues to be applied to the solenoid 50 afterwards, at the moment when clearance is formed under the rocker arm 4 by the swing of the rocker arm 4, the decompression pin 40 is inserted into the clearance by the thrust force of the solenoid 50. If the decompression device is controlled in such a way, even if there is a dispersion of the operation time of the decompression pin 40, the decompression device can surely insert the decompression pin 40 into the swing range of the rocker arm 4 and can start the decompression. In other words, the decompression device can surely start the decompression, even without strictly controlling the timing.

The description will be returned to FIG. 11 again, and the description of the time chart will be continued. In the decompressed state, the minimum lift amount of the valve 2 is restricted by the decompression lift amount. In addition, though not shown, the maximum lift amount of the valve 2 slightly decreases by the lifted amount of the end portion 4*a* of the rocker arm 4 by the decompression pin 40. While the decompression is continued, the voltage is continuously applied to the solenoid 50. However, the voltage in a period while the decompression is continued may be a voltage with which a thrust force enough to hold the decompression pin 40 against the reaction force of the spring 36 can be obtained.

When the engine stop signal is turned off in order to restart the engine, the decompression permission flag is released. When the decompression permission flag is released, a cylinder is discriminated which can first release the decompression on the basis of the TDC signal. Next, the application of the voltage to the solenoid 50 of the decompression device 10 on the cylinder is stopped which releases the decompression.

A certain operation time (for example, approximately 40 msec) is required also before the decompression pin 40 is operated by the reaction force of the spring 36 after the application of the voltage to the solenoid 50 has been stopped. The timing at which the application of the voltage to the solenoid 50 is stopped is set so that the decompression pin 40 can be operated within a time period during which the decompression pin 40 can be pulled out, in consideration of this operation time. The decompression pin 40 can be pulled out from under the rocker arm 4, approximately when the lift amount of the valve 2 becomes maximum.

From the viewpoint of suppressing the power consumption, the timing at which the application of the voltage to the solenoid 50 is stopped should be as early as possible. In addition, also from the viewpoint of the reliability of the end of the decompression, it is better that the timing is earlier at which the application of the voltage to the solenoid 50 is stopped. The decompression device 10 of the present embodiment can stop energization of the solenoid 50 before the valve 2 starts to lift in a decompression finishing cycle.

Figure 13:
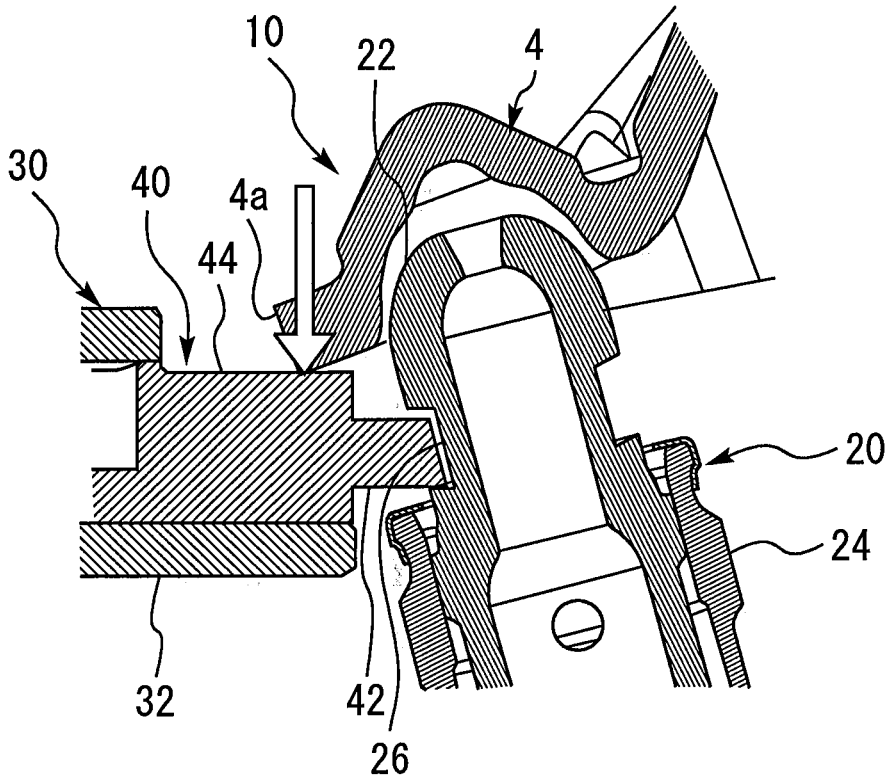
FIG. 13 is a view for describing control over the decompression device at the end of decompression.

FIG. 13 shows a view for describing the control over the decompression device 10 at the end of the decompression. For example, suppose that energization of the solenoid 50 is stopped in the decompressed state. At this time, the reaction force of the valve spring 6 works on the arm support portion 44 of the decompression pin 40 via the end portion 4*a* of the rocker arm 4, as indicated by the arrow in the figure. When the energization of the solenoid 50 is stopped, such a reaction force of the spring 36 as to push the decompression pin 40 back into the pin guide 32 works on the decompression pin 40.

However, the decompression pin 40 is sandwiched between the rocker arm 4 and the pin guide 32, by the reaction force of the valve spring 6. Because of this, even if the energization of the solenoid 50 has been stopped, the decompression pin 40 cannot be immediately pulled out. After that, when a force applied from the end portion 4*a* of the rocker arm 4 decreases by the swing of the rocker arm 4 and the reaction force of the spring 36 exceeds a friction force between the decompression pin 40 and the rocker arm 4, the decompression pin 40 is pushed back into the pin guide 32 by the reaction force of the spring 36, and is pulled out from under the rocker arm 4. If the decompression device is controlled in such a way, even if there is a dispersion of the operation time of the decompression pin 40, the decompression device can surely pull out the decompression pin 40 from the swing range of the rocker arm 4 and can end the decompression. In other words, the decompression device can surely end the decompression, even without strictly controlling the timing.

Up to this point, the control over the decompression device 10 in a period from the start of the decompression to the end of the decompression has been described, but the contents of the control of the entire vehicle differ depending on the type of the vehicle on which the decompression device 10 is mounted. Specifically, there are the following differences in the contents of the control between cases where the vehicles on which the decompression device 10 is mounted are a conventional engine vehicle and a hybrid vehicle.

Figure 14:
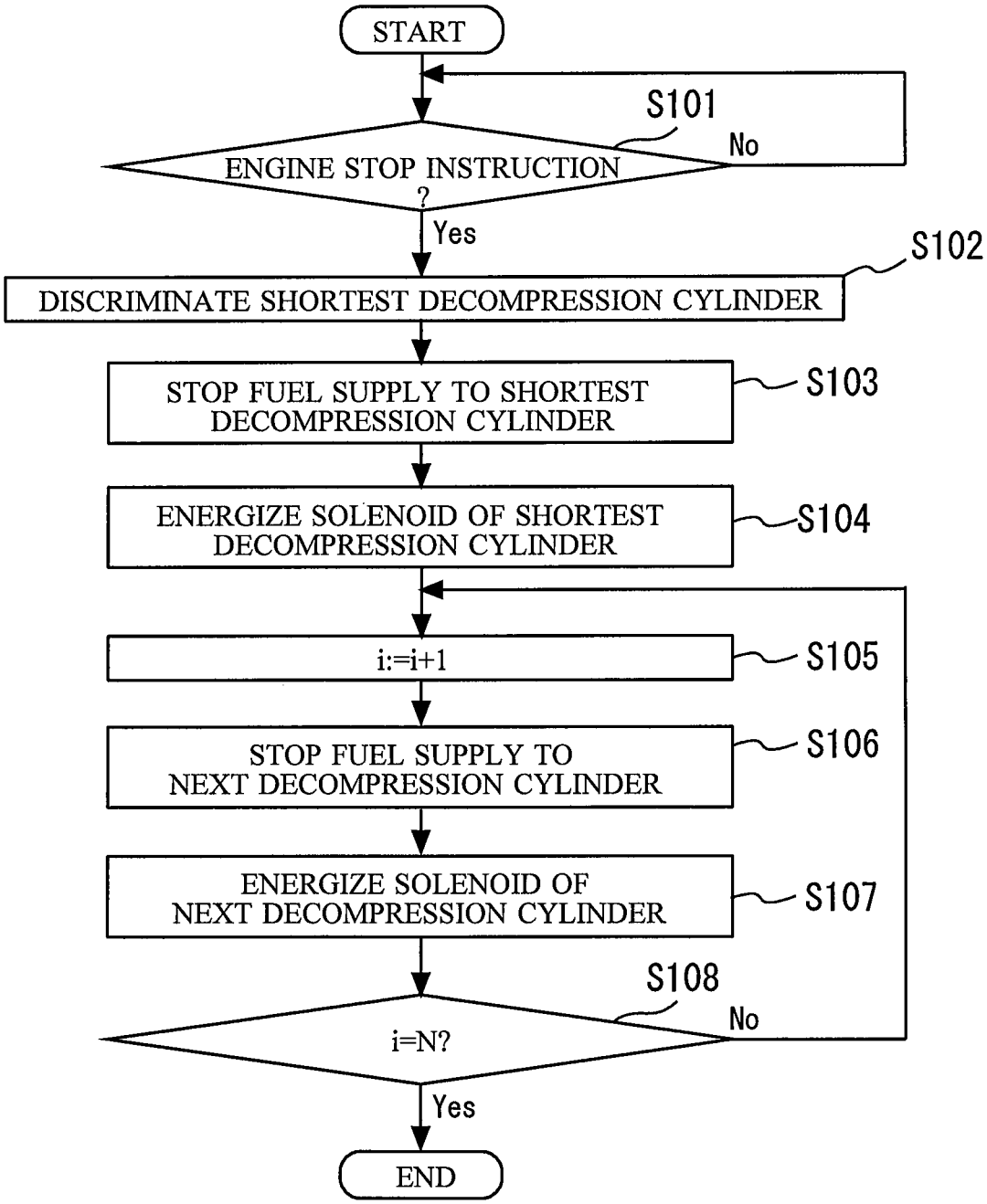
FIG. 14 is a flowchart of control at the start of decompression in a conventional engine vehicle.

FIG. 14 shows a flowchart of control at the start of the decompression in a conventional engine vehicle. In the conventional engine vehicle, the decompression is performed when the engine temporarily stops, for example, at the time of idling stop. In the conventional engine vehicle, the engine does not rotate unless combusting, and accordingly it is necessary to sequentially stop the combustion in each cylinder at the start of the decompression. Incidentally, the following processing is performed by the ECU.

In step S101, it is determined whether or not an instruction to stop the engine has been issued from the high order ECU. The determination in step S101 is repeated at a constant cycle until the instruction to stop the engine is issued.

When the instruction to stop the engine is issued, in step S102, a cylinder (shortest decompression cylinder) is discriminated which can start decompression in the shortest time, on the basis of the TDC signal. Next, in step S103, the injection of fuel to the shortest decompression cylinder is stopped. The injection of fuel is stopped before energization of the solenoid 50 starts in order to prevent the fuel from blowing through the valve 2 which has been opened by the decompression. Then, in step S104, the operation timing of the decompression pin 40 is calculated, and according to the operation timing, the solenoid 50 of the decompression device 10 on the shortest decompression cylinder is energized. As the operation timing of the decompression pin 40, for example, the timing is used which has been obtained by converting the operation time of the decompression pin 40 (designed operation time) into the crank timing according to the engine rotation number.

In step S105, the value of counter i is incremented. Next, in step S106, the injection of fuel to the next decompression cylinder is stopped. In step S107, the solenoid 50 of the decompression device 10 on the next decompression cylinder is energized. In step S108, it is determined whether or not the value of counter i has reached the number of cylinders N. In other words, the process of stopping the injection of fuel and the process of energizing the solenoid 50 are repeated for the number of cylinders provided in the engine.

Figure 15:
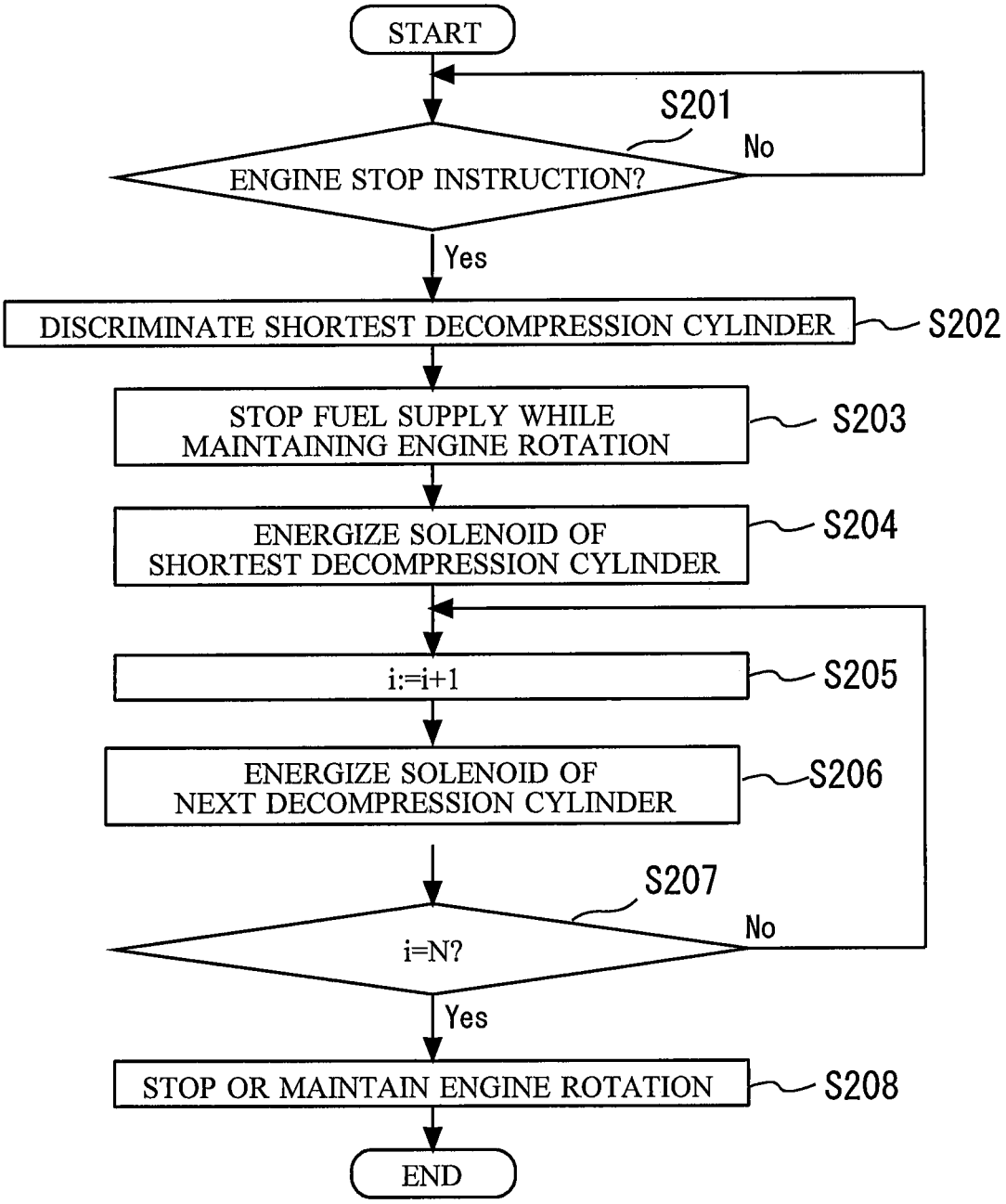
FIG. 15 is a flowchart of control at the start of decompression in a hybrid vehicle.

FIG. 15 shows a flowchart of control at the start of decompression in a hybrid vehicle. In the hybrid vehicle, the decompression is performed, for example, while the vehicle runs by a motor. In the hybrid vehicle, the engine can be rotated by the motor, and thus at the start of the decompression, the ignition can be simultaneously stopped in all the cylinders. Incidentally, the following processing is performed by the ECU.

In step S201, it is determined whether or not an instruction to stop the engine has been issued from the high order ECU. The determination in step S201 is repeated at a constant cycle until the instruction to stop the engine is issued.

When the instruction to stop the engine is issued, in step S202, a cylinder (shortest decompression cylinder) is discriminated which can start decompression in the shortest time, on the basis of the TDC signal. Next, in step S203, the injection of fuel to all the cylinders is stopped, while the rotation of the engine is maintained by the motor. Then, in step S204, the operation timing of the decompression pin 40 is calculated, and according to the operation timing, the solenoid 50 of the decompression device 10 on the shortest decompression cylinder is energized.

In step S205, the value of counter i is incremented. In step S206, the solenoid 50 of the decompression device 10 on the next decompression cylinder is energized. In step S207, it is determined whether or not the value of counter i has reached the number of cylinders N. In other words, the process of energizing the solenoid 50 is repeated by the number of cylinders provided in the engine.

When the solenoids 50 of the decompression devices 10 on all the cylinders have been completely energized, the rotation of the engine by the motor is stopped in step S208. However, the rotation of the engine by the motor can be also maintained as needed.

Figure 16:
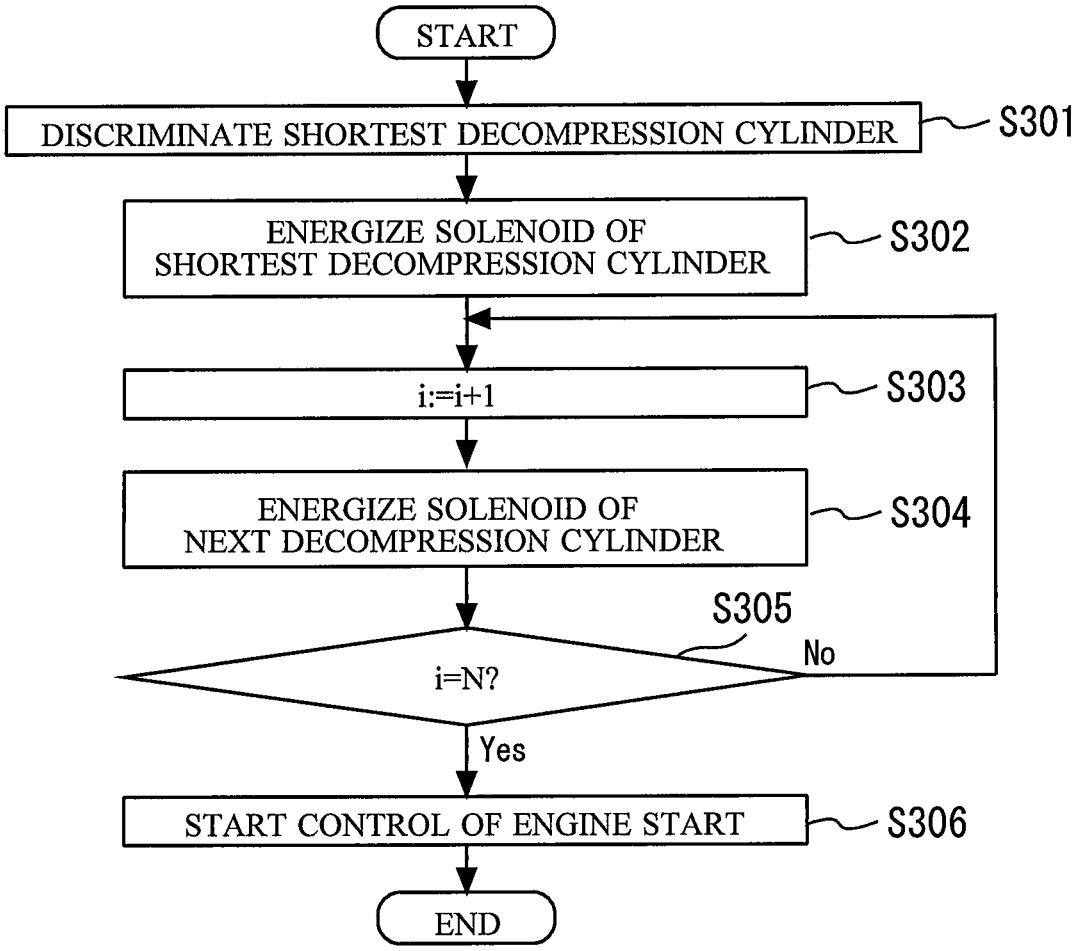
FIG. 16 is a flowchart of control at the end of decompression.

FIG. 16 shows a flowchart of the control at the end of the decompression common to the conventional engine vehicle and the hybrid vehicle. The following processing is performed by the ECU. However, in the conventional engine vehicle, this control is started with the turning on of the ignition or the start of the rotation of the starter as a trigger, but on the other hand, in the hybrid vehicle, this control is started with the engine start command sent from the high order ECU as the trigger.

In step S301, the cylinder which can finish the decompression in the shortest time (shortest decompression cylinder) is discriminated, on the basis of the TDC signal. Next, in step S302, the operation timing of the decompression pin 40 is calculated, and according to the operation timing, the energization of the solenoid 50 of the decompression device 10 on the shortest decompression cylinder is stopped. As the operation timing of the decompression pin 40, for example, the timing is used which has been obtained by converting the operation time of the decompression pin 40 (designed value of operation time) into the crank timing according to the engine rotation number.

In step S303, the value of counter i is incremented. Then, in step S304, the energization of the solenoid 50 of the decompression device 10 on the next decompression cylinder is stopped. In step S305, it is determined whether or not the value of counter i has reached the number of cylinders N. In other words, the process of stopping the energization of the solenoid 50 is repeated by the number of cylinders provided in the engine.

When the energization of the solenoids 50 of the decompression devices 10 on all the cylinders has been completely stopped, the control of the start of the engine such as the injection of the fuel or the like is started in step S306.

4. Example of Mounting of Decompression Device on Engine

In the end, an example in which the decompression device 10 of the present embodiment is mounted on an engine will be described with reference to FIG. 17 and FIG. 18. As for a constraint condition at the time when the decompression device 10 is mounted on the engine, the actuator unit 30 needs to be installed so that the driving direction of the decompression pin 40 faces the end portion 4*a* of the rocker arm 4. However, the arm support portion 44 of the decompression pin 40, which comes into contact with the end portion 4*a* of the rocker arm 4, is a flat surface, and a contact with the end portion 4*a* of the rocker arm 4 is a line contact. Accordingly, the inclination of the mounting angle within the flat surface is allowed.

Figure 17:
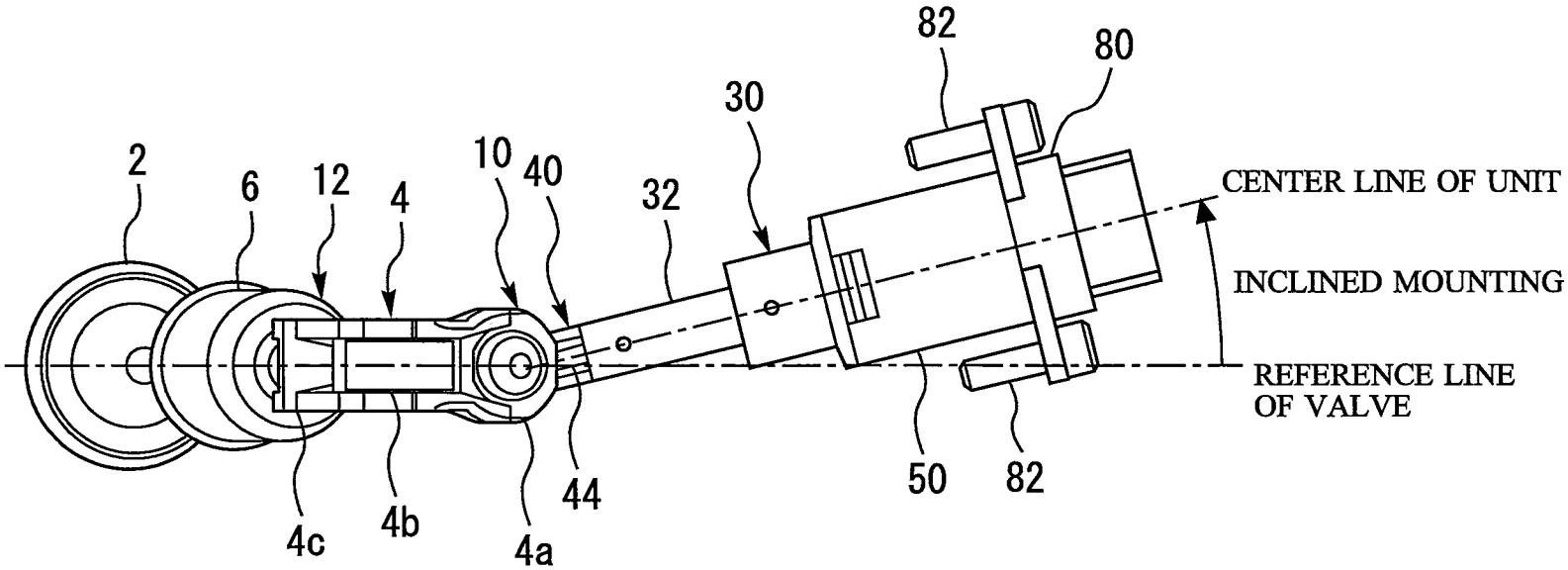
FIG. 17 is a plan view illustrating an example of a mounting angle of the actuator unit with respect to a base line of a valve.

FIG. 17 shows a plan view showing an example of a mounting angle of the actuator unit 30 with respect to the base line of the valve 2. In the example shown in FIG. 17, the actuator unit 30 is mounted so that the center line of the actuator unit 30 is inclined with respect to the base line of the valve 2, in a top view of the cylinder. In the top view of the cylinder, the base line of the valve 2 coincides with the longitudinal direction of the rocker arm 4, and the center line of the actuator unit 30 coincides with the driving direction of the decompression pin 40. Incidentally, the actuator unit 30 is mounted on the engine in such a way that the solenoid 50 is held by a holder 80 and the holder 80 is fixed to a cylinder head (not shown) by a bolt 82.

Figure 18:
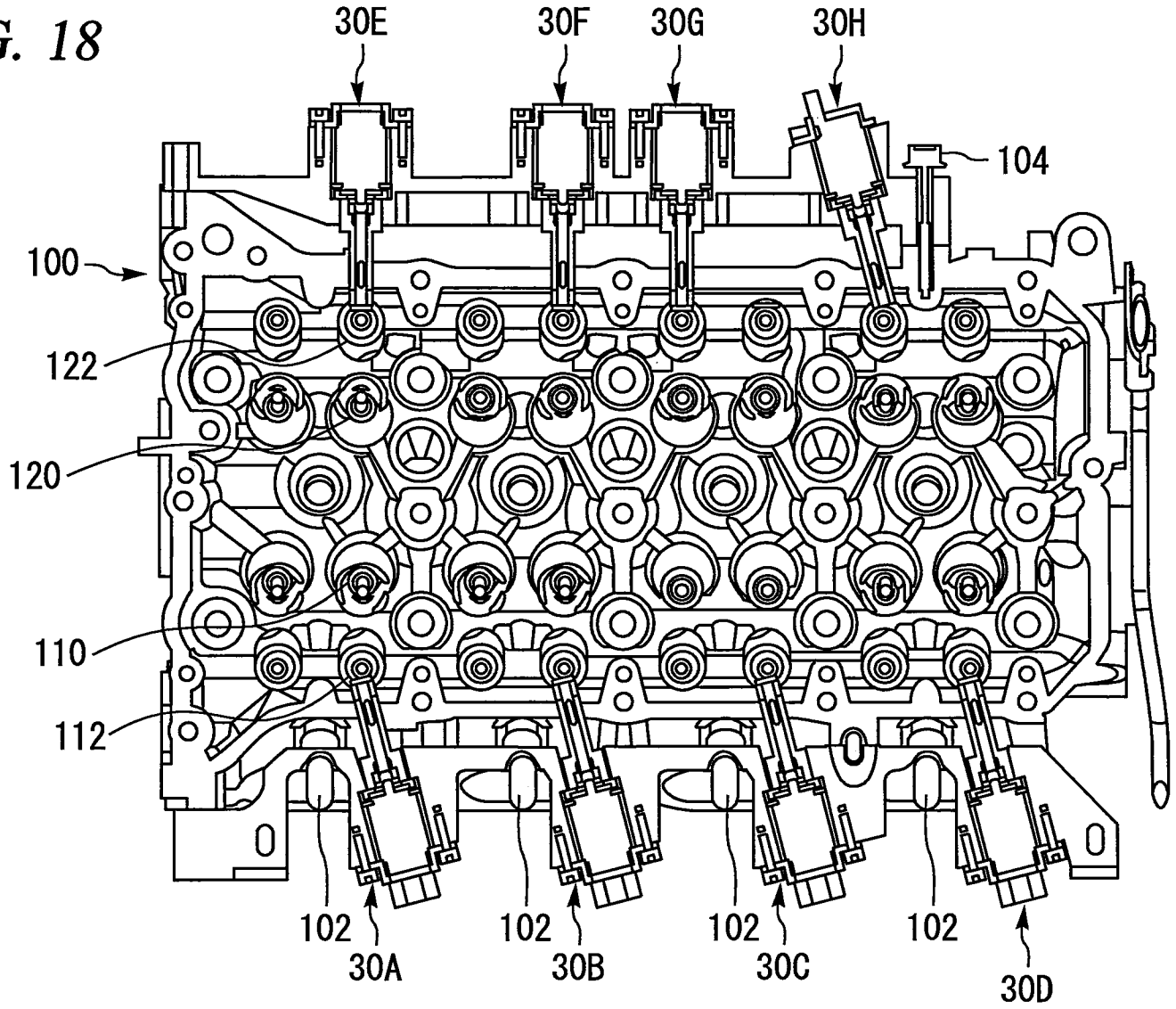
FIG. 18 is a plan view showing an example of the actuator unit mounted on a cylinder head.

FIG. 18 shows a plan view showing an example of the actuator unit 30 mounted on a cylinder head 100. The cylinder head 100 shown in FIG. 18 is a cylinder head of an inline four-cylinder engine. On the intake side of the cylinder head 100, two pairs of a valve spring 110 and a lash adjuster 112 are provided on each of the cylinders, and also on the exhaust side, two pairs of a valve spring 120 and a lash adjuster 122 are provided on each of the cylinders. In addition, one actuator unit is mounted on each of the intake side and the exhaust side of the cylinder, and eight actuator units 30A to 30H in total are mounted. Incidentally, each of the configurations of the actuator units 30A to 30H is the same as that of the actuator unit 30 described above.

On the intake side of the cylinder head 100, insertion holes 102 for attaching fuel injection valves thereto are formed for the cylinders, respectively. The actuator units 30A to 30H on the intake side are mounted so as to be inclined with respect to the base line of the valve (which is line that connects valve spring 110 with lash adjuster 112 in top view), so as not to interfere with the fuel injection valve which is attached to the insertion hole 102. On the exhaust side of the cylinder head 100, the actuator units 30E to 30G are attached straight to a base line of a valve (which is line that connects valve spring 120 with lash adjuster 122 in top view). However, an engine hanger 104 is provided in the cylinder head 100, which is used when the engine is attached/detached to/from the vehicle, and accordingly only the actuator unit 30H which interferes with the engine hanger 104 is mounted inclined to the base line of the valve.

What is claimed is:

1. A decompression device for an internal combustion engine having a valve timing mechanism including a rocker arm that receives a driving force from a cam to operate a valve in an opening direction, a valve spring that exerts a reaction force on the valve toward a closing direction, and a lash adjuster that forms a fulcrum of the rocker arm, the decompression device comprising:

a positioning member that is inserted into a swing range of an end portion of the rocker arm, on a side which is supported by the lash adjuster, when the rocker arm has been inclined toward a direction in which the valve is opened, comes into contact with the end portion of the rocker arm when the rocker arm is inclined toward a direction in which the valve is closed, and thereby restricts the rocker arm from returning to a position at which the valve is completely closed; and an actuator configured to perform an operation of inserting the positioning member into the swing range, and an operation of pulling out the positioning member from the swing range.

2. The decompression device according to claim 1, wherein the positioning member is provided with a flat portion, at a portion coming into contact with the end portion of the rocker arm.

3. The decompression device according to claim 1, wherein the positioning member comprises a plunger engagement portion that engages a plunger of the lash adjuster and restrains a movement of the plunger in an axial direction when the positioning member has come into contact with the end portion of the rocker arm.

4. The decompression device according to claim 3, wherein the actuator drives the positioning member toward the plunger in a linear direction, and the plunger engagement portion is disposed at a tip end of the positioning member.

5. The decompression device according to claim 4, further comprising a support member that guides the positioning member so as to move along the linear direction, and also supports the positioning member against the reaction force of the valve spring, which works on the positioning member via the rocker arm.

6. The decompression device according to claim 4, wherein the actuator drives the positioning member toward the plunger by a force of a solenoid when decompression starts, continues energization of the solenoid while the decompression is continued, and stops the energization of the solenoid to return the positioning member to an original position by a reaction force of a return spring connected to the positioning member, when finishing the decompression.

7. The decompression device according to claim 6, wherein the actuator starts the energization of the solenoid before an inclination of the rocker arm becomes an inclination in which the inserting of the positioning member into the swing range is possible.

8. The decompression device according to claim 6, wherein the actuator stops the energization of the solenoid before the valve starts to lift in a finishing cycle of the decompression.

9. The decompression device according to claim 4, wherein the positioning member and the actuator constitute an actuator unit, and the actuator unit is mounted on the internal combustion engine such that a driving direction of the positioning member is inclined with respect to a longitudinal direction of the rocker arm, in a top view of a cylinder.

* * * * *